United States Patent [19]

Shaffer

[11] 3,947,224

[45] Mar. 30, 1976

[54] PHOTOFLASH LAMP WITH MODIFIED POLYCARBONATE COATING

[75] Inventor: John W. Shaffer, Williamsport, Pa.

[73] Assignee: GTE Sylvania Incorporated, Danvers, Mass.

[22] Filed: Nov. 1, 1974

[21] Appl. No.: 519,966

[52] U.S. Cl. ..... 431/94
[51] Int. Cl.[2] ..... F21K 5/02
[58] Field of Search ..... 431/94

[56] References Cited

UNITED STATES PATENTS

| | | | |
|---|---|---|---|
| 3,156,107 | 11/1964 | Shaffer | 431/94 |
| 3,492,268 | 1/1970 | Baker | 260/47 X |
| 3,635,895 | 1/1972 | Kramer | 260/47 X |
| 3,770,366 | 11/1973 | Audesse et al. | 431/94 |

*Primary Examiner*—Carroll B. Dority, Jr.
*Attorney, Agent, or Firm*—Edward J. Coleman

[57] ABSTRACT

A photoflash lamp having a protective coating over its glass envelope which is composed of an acidified polycarbonate resin for providing a strong containment vessel with improved aging charcteristics under conditions of stress and humidity. A preferred coating comprises a vacuum-formed sleeve composed of a polycarbonate resin with a phthalic anhydride additive.

9 Claims, 4 Drawing Figures

PHOTOFLASH LAMP WITH MODIFIED POLYCARBONATE COATING

CROSS-REFERENCE TO RELATED APPLICATION

A modified polycarbonate resin useful as a protective coating for the photoflash lamp of the present invention is disclosed and claimed in copending application Ser. No. 519,964 filed concurrently herewith in the name of the present inventor and assigned to the present assignee.

BACKGROUND OF THE INVENTION

This invention relates to photoflash lamps and, more particularly, to an improved protective coating for flashlamps.

A typical photoflash lamp comprises an hermetically sealed glass envelope, a quantity of combustible material located in the envelope, such as shredded zirconium of hafnium foil, and a combustion supporting gas, such as oxygen, at a pressure well above one atmosphere. The lamp also includes an electrically or percussively activated primer for igniting the combustible to flash the lamp. During lamp flashing, the glass envelope is subject to severe thermal shock due to hot gloubles of metal oxide impinging on the walls of the lamp. As a result, cracks and crazes occur in the glass and, at higher internal pressures, containment becomes impossible. In order to reinforce the glass envelope and improve its containment capability, it has been common practice to apply a protective lacquer coating on the lamp envelope by means of a dip process. To build up the desired coating thickness, the glass envelope is generally dipped a number of times into a lacquer solution containing a solvent and a selected resin, typically cellulose acetate. After each dip, the lamp is dried to evaporate the solvent and leave the desired coating of cellulose acetate, or whatever other plastic resin is employed.

In the continuing effort to improve light output, higher performance flashlamps have been developed which contain higher combustible fill weights per unit of internal envelope volume, along with higher fill gas pressure. In addition, the combustible material may be one of the hotter burning types, such as hafnium. Such lamps, upon flashing, appear to subject the glass envelopes to more intense thermal shock effects, and thus require stronger containment vessels. One approach to this problem has been to employ a hard glass envelope, such as the borosilicate glass envelope described in U.S. Pat. No. 3,506,385, along with a protective dip coating of cellulose acetate. Although providing some degree of improvement in the containment capability of lamp envelopes, the use of cellulose acetate dip coatings and hard glass present significant disadvantages in the areas of manufacturing cost and safety. More specifically, the hard glass incurs considerable added expense over the more commonly used soft glass due to both increased material cost and the need for special lead-in wires to provide sealing compatibility with the hard glass envelope. In addition, even though more resistant to thermal shock, hard glass envelopes can also exhibit cracks and crazes upon lamp flashing, and, thus, do not obviate the need for a protective coating.

Another approach toward providing an improved containment vessel for photoflash lamps has been to employ a stronger, more temperature resistant coating material on the exterior of the glass envelope. For example U.S. Pat. No. 3,156,107 describes a flashlamp having an exterior coating of polycarbonate resin, a material which exhibits relatively high impact and tensile strengths and a high softening temperature.

Yet a further approach to providing a more economical and improved containment vessel is described in a copending application Ser. No. 268,576, filed July 3, 1973, now U.S. Pat. No. 3,893,797, and assigned to the assignee of the present application. According to this previously filed application, a thermoplastic coating, such as polycarbonate, is vacuum formed onto the exterior surface of the glass envelope. The method of applying the coating comprises: placing the glass envelope within a preformed sleeve of the thermoplastic material; drawing a vacuum in the space between the thermoplastic sleeve and the glass envelope; and, simultaneously heating the assembly incrementally along its length, whereby the temperature and vacuum cause the thermoplastic to be incrementally formed onto the glass envelope with the interface substantially free of voids, inclusions and the like. This method provides an optically clear protective coating by means of a significantly faster, safer and more economical manufacturing process, which may be easily integrated on automated production machinery.

Heat is employed in applying the polycarbonate resin coatings on the lamp envelopes by thermoforming. Subsequent cooling of the glass envelope and polycarbonate coating causes the buildup of high tensile forces in the coating because it tends to contact more than the glass. These forces can be reduced somewhat by heating a narrow band of the coating as described in U.S. Pat. No. 3,832,257. It has been found, however, that even such stress relieved coatings can crack and fail in a relatively short time under conditions of high humidity, even when the remaining stresses are within the accepted design limits for the polycarbonate resin used. It should be noted here that unstressed polycarbonate has good resistance toward humidity or even water immersion. In searching for a solution to this aging, or shelf-life, problem under humid conditions, an extensive literature survey failed to shed light on the cause of this unexpected cracking under stress levels allowed by good design practices.

Consideration was then given to the incorporation of a compatible plasticizer into the resin with the anticipation that it might promote relaxation and stretching and thereby relieve the stresses caused by differential contraction between the coating and glass. Evaluation of coatings containing, for example, 20 to 30 parts of a plasticizer to 100 parts of resin did in fact show significantly improved life under humid conditions. The plasticized polycarbonate was quite rigid rather than extensible as had been expected and, therefore, did not function in the manner anticipated. That is, the reduced coating stresses obtained with the plasticized resin were the result of a considerable lowering of the softening temperature needed for thermoforming. Cooling of the coated lamp over a lesser temperature gradient resulted in less stress build up. The shortcoming of this approach, however, was that the introduction of the required amounts of plasticizer resulted in substantial weakening of the coating, when compared to unplasticized polycarbonate. The resulting plasticized polycarbonate did not provide the desired stronger protective coating; more specifically, the plasticized polycarbonate coatings were not consistently better than cellulose acetate lacquer in containment tests with overcharged lamps. In addition, with respect to the preformed polycarbonate sleeves which are vacuum-formed onto the lamp, the low set point and poor strength at elevated temperatures of the plasticized polycarbonate made extraction from the mold of the injection molded sleeves a difficult, slow and uneconomical process.

SUMMARY OF THE INVENTION

In view of the foregoing, it is an object of this invention to provide a photoflash lamp having a strong protective coating with improved aging characteristics.

It is a particular object of the invention to provide an improved polycarbonate coating for a flashlamp which exhibits a prolonged time to failure under conditions of high humidity and high mechanical stress.

A further object is to provide an improved containment vessel for a flash lamp by employing on the glass envelope of the lamp an exterior coating of a modified polycarbonate resin which retains the toughness and high softening temperature for which polycarbonate is known, but which affords substantially improved resistance toward stress cracking of such coatings under humid conditions.

These and other objects, advantages and features are attained in accordance with the invention by coating the exterior surface of the glass envelope of the lamp with a polycarbonate resin which is acidified to counteract any alkali-catalyzed hydrolysis of the resin and thereby prolong the time to failure of the resin under conditions of high humidity and high mechanical stress. By deliberately rendering the resin acidic, rather than neutral, the time to crack development can be extended significantly. Whereas the actual time to failure is influenced by stress level, temperature and humidity, the lifetime ratio of acidified to nonacidified polycarbonate appears to be relatively constant under diverse conditions of testing.

BRIEF DESCRIPTION OF THE DRAWINGS

This invention will be more fully described hereinafter in conjunction with the accompanying drawings, in which.

DESCRIPTION OF PREFERRED EMBODIMENT

The teachings of the present invention are applicable to either percussive or electrically ignited photoflash lamps of a wide variety of sizes and shapes. Accordingly, FIGS. 1 and 2 respectively illustrate electrically ignited and percussive-type photoflash lamps embodying the principles of the invention.

Figure 1:
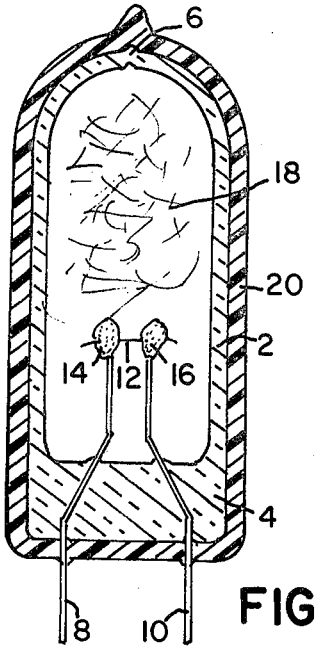
FIG. 1 is an enlarged sectional elevation of an electrically ignitable photoflash lamp having a protective coating in accordance with the invention.

Referring to FIG. 1, the electrically ignitable lamp comprises an hermetically sealed lamp envelope 2 of glass tubing having a press 4 defining one end thereof and an exhaust tip 6 defining the other end thereof. Supported by the press 4 is an ignition means comprising a pair of lead-in wires 8 and 10 extending through and sealed into the press. A filament 12 spans the inner ends of the lead-in wires, the beads of primer 14 and 16 are located on the inner ends of the lead-in wires 8 and 10 respectively at their junction with the filament. Typically, the lamp envelope 2 has an internal diameter of less than one-half inch, and an internal volume of less than 1 cc., although the present invention is equally suitable for application to larger lamp sizes. A combustion-supporting gas, such as oxygen, and a filamentary combustible material 18, such as shredded zirconium or hafnium foil, are disposed within the lamp envelope. Typically, the combustion-supporting gas fill is at a pressure exceeding one atmosphere, with the more recent subminiature lamp types having oxygen fill pressures of up to several atmospheres. As will be described in more detail hereinafter, the glass envelope 2 is reinforced, in accordance with the invention, by an acidified polycarbonate coating 20 on its exterior surface.

Figure 2:
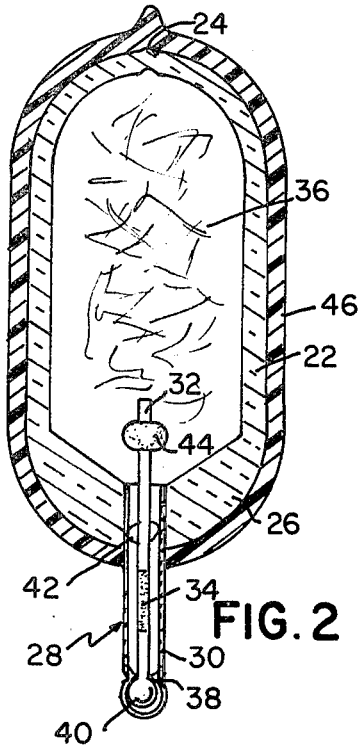
FIG. 2 is an enlarged sectional elevational of a percussive-type photoflash lamp having a protective coating in accordance with the invention.

The percussive-photoflash lamp illustrated in FIG. 2 comprises a length of glass tubing defining an hermetically sealed lamp envelope 22 constricted at one end to define an exhaust tip 24 and shaped to define a seal 26 about a primer 28 at the other end thereof. The primer 28 comprises a metal tube 30, a wire anvil 32, and a charge of fulminating material 34. A combustible 36, such as filamentary zirconium or hafnium, and a combustion supporting gas, such as oxygen, are disposed within the lamp envelope, with the fill gas being at a pressure of greater than one atmosphere. As will be detailed hereinafter, the exterior surface of glass envelope 22 is covered by an acidified polycarbonate coating 46 in accordance with the invention.

The wire anvil 32 is centered within the tube 30 and is held in place by a circumferential indenture 38 of the tube 30 which loops over the head 40, or other suitable protuberance, at the lower extremity of the wire anvil. Additional means, such as lobes 42 on wire anvil 32 for example, may also be used in stabilizing the wire anvil, supporting it substantially coaxial within the primer tube 30 and insuring clearance between the fulminating material 34 and the inside wall of tube 30. A metal or glass bead 44 is fused to the wire anvil 32 just above the inner mouth of the primer tube 30 to eliminate burn-through and function as a deflector to deflect and control the ejection of hot particles of fulminating material from the primer. The lamp of FIG. 2 is also typically a subminiature type having envelope dimensions similar to those described with respect to FIG. 1.

Although the lamp of FIG. 1 is electrically ignited, usually from a battery source, and the lamp of FIG. 2 is percussion-ignitable, the lamps are similar in that in each the ignition means is attached to one end of the lamp envelope and disposed in operative relationship with respect to the filamentary combustible material. More specifically the igniter filament 12 of the flash lamp in FIG. 1 is incandesced electrically by current passing through the metal filament support leads 8 and 10, whereupon the incandesced filament 12 ignites the beads of primer 14 and 16 which in turn ignite the combustible 18 disposed within the lamp envelope. Operation of the percussive-type lamp of FIG. 2 is initiated by an impact onto tube 30 to cause deflagration of the fulminating material 34 up through the tube 30 to ignite the combustible 36 disposed within the lamp envelope. The invention is also applicable to other types of electrically ignited lamps, such as those having spark gap or primer bridge ignition structures.

In accordance with the invention, I have found that a significant improvement in the stressed-part humidity tolerance of polycarbonate coatings on flashlamps can be achieved by employing a resin which has been acidified, such as by blending a compatible acidifying agent into the resin.

Polycarbonate resins are polymeric materials which incorporate the carbonate radical

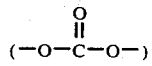

as an integral part of the main polymer chain. In polycarbonate synthesis, a dihydroxy aromatic compound undergoes reaction with a carbonyl compound to yield long chain molecules which consist of alternate aromatic and carbonate groups. An example of such a polyarylcabonate resin is the product of the reaction between phosgene and 2,2-bis(4-hydroxypenyl) propane (bisphenol A) in the presence of a basic substance such as pyridine. The structure of this polymer is:

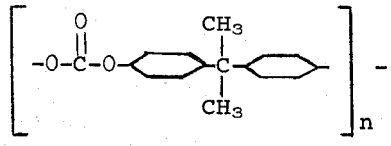

In commercial polycarbonate resins, the number of repeating units, *n*, is such that the molecular weight is from about 25,000 to 75,000.

It is hypothesized that stress cracking of the polycarbonate under humid conditions is accompanied by localized scission of the polymer chains due to a hydrolytic mechanism. Small traces of alkali, either in the resin or its environment, appear to greatly accelerate this hydrolytic mechanism and probably act by way of basic catalysis. It has been shown that sufficient alkali is released from glass, as for example a lamp envelope, to measurably promote such failure of the polycarbonate in the presence of moisture. By adding an acidifying agent to the polycarbonate resin in accordance with the invention, a dramatic improvement in humidity tolerance is obtained which may be explained on the basis of the additive reacting with and thereby eliminating the traces of catalytic alkali that enter the resin.

As a preferred acidifying agent, I have found phthalic anhydride to offer effective hydrolytic stabilization to polycarbonate resins while at the same time providing high transparency, freedom from discoloration or haze, and good retention of thermal and mechanical properties. Other acids and acid anhydrides that are soluble in polycarbonate resin may be used; however, to attain the high degree of optical transparency required for photoflash lamp coatings, a truly soluble agent, such as phthalic anhydride is needed.

The quantity of acidifying agent used may be varied from about 0.1 percent to as much as 30 percent by weight in the modified polycarbonate resin, depending on end use requirements. That is, the modified resin comprises a homogeneous mixture of from about 70 to 99.9 percent by weight of a polycarbonate resin and from about 0.1 to 30 percent by weight of a compatible acidifying agent. At very low concentrations, the acidic additive will serve to insure freedom from harmful residual traces of alkali in the resin itself; however, protection from externally introduced alkali, as for example, from contact with a substance such as glass, will be inconsequential. At very high concentrations of additive, the alkali tolerance is increased, but the thermal and mechanical properties will suffer somewhat, as was found with plasticized polycarbonate. For flashlamp coating applications, an acidifying agent concentration from about 0.5 to 1.5 percent by weight is deemed optimal. That is, the acidified resin of a flashlamp coating comprises a homogeneous mixture of from about 98.5 to 99.5 percent by weight of polycarbonate resin and from about 0.5 to 1.5 percent by weight of an acidifying agent which is soluble in the resin.

The choice of acid or acid anhydride for the desired protective effect is not considered critical and many such substances could be used interchangeably. More specifically, an acid or anhydride of an acid having a first ionization pKa value in a range of from about 1.0 to 6.5 will function within the spirit of the invention, provided the agent chosen is sufficiently soluble in the polycarbonate resin so as to give a homogeneous mixture with the degree of optical clarity required. Acidifying agents with a pKa value between 1.5 and 4.5 are preferred because of their greater effectiveness or ability to maintain the resin acidic at low concentrations and/or after being largely depleted through reaction with alkaline materials.

The acidifying agent should also have a sufficiently high boiling point (or low vapor pressure at polycarbonate processing temperatures), to not cause bubbles or voids in the coating on the finished flashlamp.

By way of example, the following are among the acidifying agents that would appear suitable for use as an additive to modify polycarbonate resin for use as a flashlamp coating in accordance with the invention.

| Additive | (First Ionization) pKa | Boiling Point °C |
|---|---|---|
| benzoic acid | 4.19 | 249 |
| phthalic anhydride | (acid 2.89) | 284 |
| phenylacetic acid | 4.28 | 266 |

An alternative to the addition of acidic materials to polycarbonate resins is to incorporate a source of acid internal to the molecular structure itself. By way of illustrative example only, acidic moieties such as carboxyl groups could be affixed regularly or at random along the length of the polycarbonate chain. Such internally acidified polycarbonate resins should offer properties and advantages similar to those obtained through blending of an acidic substance into an unmodified resin.

Figure 3:
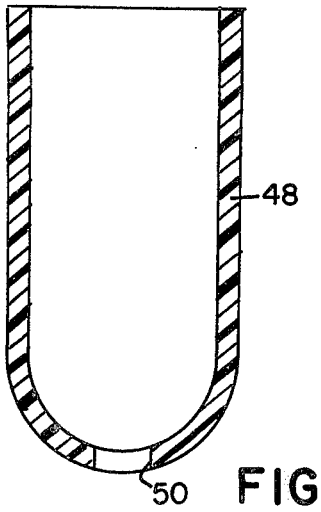
FIG. 3 is an enlarged sectional elevation of a preformed sleeve of modified polycarbonate adapted for assembly and vacuum forming onto the glass envelope of a percussive-type photoflash lamp; and, FIG. 4 is an enlarged elevation, partly in section, showing a percussive flashlamp assembly in the sleeve of FIG. 3, prior to vacuum forming.

One method of applying the acidified polycarbonate resin coatings 20 and 46 to the flashlamps of FIG. 1 and 2 would be to employ a lacquer dip process, similar to that described in U.S. Pat. No. 3,156,107. Another method of application is to employ a fluidized bed process, such as that described in a copending application Ser. No. 482,038, filed June 24, 1974 and assigned to the present assignee, with the acidified polycarbonate resin being initially provided in powder form for subsequent fluidization in this process. However, the previously referred to vacuum-forming method of application is preferred and shall now be briefly described. Referring to FIG. 3, the acidified polycarbonate resin to be coated on the exterior surface of the lamp envelope is initially provided as a preformed sleeve 48 having the shape of a test tube. To facilitate the one or more metallic members depending from the lamp envelope (i.e. leads 8 and 10, or primer tube 30) one or more holes are provided at the bottom of test tube-shaped sleeve. For purposes of example, the method will be described with reference to vacuum forming the coating 46 on the percussive lamp of FIG. 2, although it will be understood that a similar method may be employed with the electrically ignited lamp of FIG. 1. Accordingly, sleeve 48 is provided with a single coaxially disposed hole 50 to facilitate passage of coaxially projecting primer tube 30. Sleeve 48 may be formed by a molding or extrusion process, and to minimize possible checks and crazes in the plastic upon being vacuum formed to the glass envelope, the preformed sleeve 48 should be prebaked at about 125°C for at least 15 minutes to drive away residual moisture prior to assembly with the glass envelope.

Figure 4:
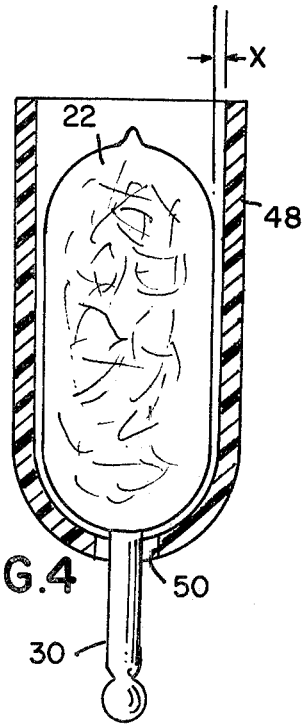

In the next step, shown in FIG. 4, the glass envelope 22 of the percussive lamp is place within the preformed sleeve 48, with the primer tube 30 projecting through hole 50. It will be noted that both the sleeve 48 and the lamp envelope 22 have generally tubular sidwalls. To facilitate the vacuum forming process, the fit should be as close as possible. Accordingly, the outside diameter of the tubular envelope 22 and the inside diameter of the tubular sleeve 48 are dimensioned so that, when the envelope is placed within the sleeve, there exists a clearance $x$ of from about 0.001 to 0.010 inch between the tubular sidewalls thereof prior to heating and vacuum forming.

The next step, heating and vacuum forming comprises drawing a vacuum in the space between the sleeve 48, and envelope 22, while simultaneously heating the envelope and sleeve assembly incrementally along its length. More specifically, the vacuum is drawn through a tube at the open end of sleeve 48, while at the same time, heaters are controlled to heat the sleeve to approximately the softening temperature of the acidified resin. A relative incremental axial movement is effected between the envelope-sleeve assembly and the heaters, so that incremental heating in a localized elevational plane starts at the end of the sleeve 48 through which the primer tube 30 projects, and then proceeds toward the open end of the sleeve from which the vacuum is being drawn. In this manner, the temperature and vacuum cause the sleeve 48 to be formed onto the glass envelope 22 with the interface therebetween substantially free of voids, inclusions and the like.

At the conclusion of the incremental heating process, the sleeve 48 is constricted above the exhaust tip 24 while continuing to apply heat and draw a vacuum. Finally, the vacuum-formed sleeve 48 on the lamp is separated from the scrap portion of the sleeve and tipped off, thereby completing the encapsulation of glass envelope 22 in the acidified polycarbonate resin coating 46. Commercial blue dyes can be used in the sleeve, or coating, for color corrections desirable with various photographic color films.

As the acidified polycarbonate resin has a coefficient of thermal expansion several times greater than the coefficient of thermal expansion of the glass envelope, the coating 46, provided by the above described vacuum-forming process, will exert a compressive load on the glass envelope 22 to thereby in effect strengthen the glass and make it more resistant to thermal shock. For example, with a coefficient of thermal expansion at least six times greater than that for the glass, the acidified polycarbonate coating may exert a compressive load of from about 1000 to about 3000 pounds per square inch on the glass envelope, depending upon the relative thicknesses of the envelope and coating. Preferred tensile loading in the coating would be from 1000 to no more than 2000 psi.

In one typical embodiment of the invention, an electrical flashlamp of the type shown in FIG. 1 was provided with a clear vacuum-formed coating 20 of acidified polycarbonate resin having a wall thickness of about 0.027 inch. More specifically, the coating material comprised a homogeneous mixture of about 99 percent by weight of an injection molding grade of bisphenol A polycarbonate resin (specifically Merlon type M-50 resin of the Mobay Chemical Co., Pittsburgh, Pa.) and about 1 percent by weight of phthalic anhydride. The lamp contained a combustible fill 18 comprising 25 mgs. of shredded hafnium foil and oxygen at a fill pressure of about 12.8 atmospheres. The tubular envelope 2 was formed of G-1 type soft glass and had a nominal outside diameter of 0.259 inch, a wall thickness of 0.030 inch, an overall outside length of 0.980 inch, and an internal volume of 0.32 cc. In the process of coating the lamp, an injection molded sleeve of clear acidified polycarbonate resin having nominal inside diameter of about 0.283 inch of the open end, which narrows to about 0.268 inch, and a wall thickness of 0.025 inch was employed. The sleeve had two holes at the bottom for accommodating leads 8 and 10. During vacuum forming, the molded sleeve was incrementally heated to a temperature of about 400°F by air from a serpentine heater. Flashing of a number of these lamps in both the vertical and horizontal position exhibited no containment failures.

Percussive lamps of the type shown in FIG. 2 have also been coated in similar fashion with acidified polycarbonate resin. Accelerated humidity tests indicate a dramatic retardation of crack development when the polycarbonate resin is acidified.

In summary, the present invention provides a modified polycarbonate coating for flashlamps which has a substantially improved tolerance to humid environments without at the same time destroying the good tensile and impact strength at elevated temperatures which make polycarbonate a particularly desirable material for many applications. Use of the modified resin permits significant increases in the life expectancy of stressed polycarbonate parts that are subjected to humid environments.

Although the invention has been described with respect to specific embodiments, it will be appreciated that modifications and changes may be made by those skilled in the art without departing from the true spirit and scope of the invention.

What I claim is:

1. A photoflash lamp comprising an hermetically sealed glass envelope, a combustion supporting gas in said envelope, a quantity of combustible material located in said envelope, ignition means attached to said envelope and disposed in operative relationship to said combustible material, and a protective coating on the exterior surface of said glass envelope, said coating comprising a polycarbonate resin which is acidified to counteract any alkalicatalyzed hydrolysis of the resin and thereby prolong the time to failure of said resin under conditions of high humidity and high mechanical stress.

2. A lamp according to claim 1 wherein said coating is vacuum-formed on said envelope and exerts a compressive load on the glass envelope of from about 1000 to about 3000 pounds per square inch.

3. A lamp according to claim 1 wherein said coating comprises a preformed sleeve of acidified polycarbonate resin which has been vacuum-formed onto said glass.

4. A lamp according to claim 1 wherein the acidified resin of said coatign comprises a homogeneous mixture of from about 70 to 99.9 percent by weight of a polycarbonate resin and from about 0.1 to 30 percent by weight of a compatible acidifying agent consisting of an organic carboxylic acid having a first ionization pKa value in a range of from about 1.0 to 6.5 or an anhydride thereof.

5. A lamp according to claim 4 wherein said acidifying agent has a first ionization pKa value between about 1.5 and 4.5.

6. A lamp according to claim 4 wherein said acidifying agent has a boiling point sufficiently high to preclude bubbles or voids in said coating pursuant to the processing thereof.

7. A lamp according to claim 6 wherein said acidifying agent is soluble in said polycarbonate resin, and said coating is clear.

8. A lamp according to claim 4 wherein the acidified resin of said coating comprises a homogeneous mixture of from about 98.5 to 99.5 percent by weight of a polycarbonate resin and from about 0.5 to 1.5 percent by weight of an acidifying agent which is soluble in said resin.

9. A lamp according to claim 4 wherein said acidifying agent is phthalic anhydride.

* * * * *